US009263019B2

(12) United States Patent
Dahl

(10) Patent No.: US 9,263,019 B2
(45) Date of Patent: Feb. 16, 2016

(54) PERCUSSION INSTRUMENT AND METHOD OF MANUFACTURE

(71) Applicant: Jon Greg Dahl, Grants Pass, OR (US)

(72) Inventor: Jon Greg Dahl, Grants Pass, OR (US)

( * ) Notice: Subject to any disclaimer, the term of this patent is extended or adjusted under 35 U.S.C. 154(b) by 106 days.

(21) Appl. No.: 13/938,530

(22) Filed: Jul. 10, 2013

(65) Prior Publication Data

US 2014/0013930 A1 Jan. 16, 2014

Related U.S. Application Data

(60) Provisional application No. 61/670,265, filed on Jul. 11, 2012.

(51) Int. Cl.
*G10H 3/14* (2006.01)
*G10H 1/32* (2006.01)

(52) U.S. Cl.
CPC ..... *G10H 3/143* (2013.01); *G10H 1/32* (2013.01); *G10H 3/146* (2013.01); *G10H 2220/525* (2013.01); *G10H 2230/275* (2013.01)

(58) Field of Classification Search
CPC ..... G10D 13/00; G10D 3/00; G10K 1/07; G10K 3/00; G10K 1/071; G10K 1/063; G10K 1/10; G10K 1/26; G10K 1/28
USPC ..... 84/402–410
See application file for complete search history.

(56) References Cited

U.S. PATENT DOCUMENTS

| | | | | |
|---|---|---|---|---|
| 4,165,671 | A | 8/1979 | De Bose | |
| 5,212,331 | A | 5/1993 | Waldo | |
| D372,054 | S | 7/1996 | Meyer | |
| 5,602,354 | A | 2/1997 | Martin | |
| D380,239 | S | 6/1997 | Zur | |
| 5,659,143 | A | 8/1997 | Isackson | |
| D388,322 | S | 12/1997 | Hoeting et al. | |
| 5,955,125 | A | 9/1999 | Hoeting et al. | |
| 6,093,428 | A | 7/2000 | Hoeting et al. | |
| D437,362 | S | 2/2001 | Campbell | |
| 6,255,572 | B1 | 7/2001 | Moghaddam | |
| 6,365,810 | B1 | 4/2002 | Enhoffer et al. | |
| 6,392,129 | B1 | 5/2002 | Enhoffer et al. | |
| 6,555,736 | B1 | 4/2003 | Delosreyes | |
| 6,620,991 | B1 | 9/2003 | Honiball | |
| 7,045,695 | B1 | 5/2006 | Cohen | |
| D601,617 | S | 10/2009 | Cohen | |
| 8,648,244 | B2 * | 2/2014 | Dahl | 84/730 |
| 2013/0192449 | A1 | 8/2013 | Dahl | |

* cited by examiner

*Primary Examiner* — Kimberly Lockett
(74) *Attorney, Agent, or Firm* — Greenblum & Bernstein, P.L.C.

(57) ABSTRACT

A percussion instrument including a first acoustic chamber housing having a tapered shape, a second acoustic chamber housing having the tapered shape, a sound board having the tapered shape arranged between the first acoustic chamber housing and the second acoustic chamber housing to form a first acoustic chamber defined by the first acoustic chamber housing and the sound board, and a second acoustic chamber defined by the second acoustic chamber housing and the sound board.

24 Claims, 8 Drawing Sheets

PERCUSSION INSTRUMENT AND METHOD OF MANUFACTURE

CROSS REFERENCE TO RELATED APPLICATION

The present application claims the benefit of U.S. Provisional Application No. 61/670,265 filed on Jul. 11, 2012, the disclosure of which is expressly incorporated by reference herein in its entirety.

BACKGROUND OF THE INVENTION

1. Field of the Invention

The present invention relates generally to a percussion instrument, and in particular, a multi-percussive acoustic/electric lap cajón hand drum.

2. Description of the Related Art

In small venues, a drummer may not be able to play due to the lack of space for a full-sized drum set. The lack of percussion can create a void in the musical experience of the performance as well as for the audience. The fullest percussive potential has not yet been achieved by artists, as there are many sounds and textures that are not yet available for convenient musical use.

A cajón is a box-shaped percussion instrument originally from Peru, played by slapping the front face of the box with the hands. With a conventional cajón, a six-sided box generally includes thicker wood for five sides of the box (e.g., one-half to three-quarter inch (1.3 to 2 cm)), and a thin sheet of plywood as the sixth side, which acts as the striking surface or "head." A sound hole is cut on the back side opposite the head. The top edges of the sixth side are often left unattached and can be slapped against the box. The player sits astride the box, tilting it at an angle while striking the head between his knees. The conventional cajón may have several screws at the top for adjusting percussive timbre and may include rubber feet. Some versions may also have several vertically stretched cords pressed against the "head" for a buzz like effect or tone. Guitar strings, rattles or drum snares, for example, may be used as the chords. The percussionist can play the sides with the top of his palms and fingers for additional sounds.

Cajón drums, however, are difficult to amplify without a proper sound system, which limits their use. Furthermore, due to their size and weight, conventional cajón drums are burdensome for musicians to transport and carry. Additionally, cajón drums are often one sided, which can limit the musician's use of the instrument. Buying multiple drums or instruments can be costly and challenging for users. Accordingly, an effective and versatile solution is desired.

SUMMARY OF THE INVENTION

The present invention is a percussion instrument, and more particularly, multi-percussive hand drum designed to create varied and rhythmic sounds for musical accompaniment or as a stand-alone instrument. The present invention allows percussionists to experiment with innovative percussive methods, including hand drum methods. In embodiments, the present invention includes a pickup device (e.g., a piezo pickup) to provide amplifying abilities for the sounds generated with the percussion instrument.

By implementing the present invention, the percussion instrument can take the place of a large drum set, for example, in small venues, or be used as its own percussive section in large venues. Additionally, in embodiments, when plugged into one or more floor effects units (e.g., stomp box pedals and/or multi-effect units) and/or rack mounted effects units via the integrated pickup and jack, the possibilities for sonic variation are endless.

Aspects of embodiments of the present invention are directed to a percussion instrument, comprising a first acoustic chamber housing having a tapering shape, a second chamber housing having the tapering shape, a sound board having the tapering shape arranged between the first acoustic chamber housing and the second acoustic chamber housing to form a first acoustic chamber defined by the first acoustic chamber housing and the sound board, and a second acoustic chamber defined by the second acoustic chamber housing and the sound board.

In embodiments, the percussion instrument further comprises a pickup device arranged on the sound board.

In further embodiments, the pickup device comprises a piezo transducer.

In additional embodiments, the percussion instrument further comprises an instrument jack connected to the pickup device and arranged at an exterior surface of the percussion instrument.

In embodiments, the sound board is structured and arranged substantially parallel to a longitudinal axis of the percussion instrument.

In further embodiments, the first and/or second acoustic chamber housing comprises at least one sound hole.

In additional embodiments, the sound board is structured and arranged to resonate.

In yet further embodiments, the first acoustic chamber, the second acoustic chamber housing, and the sound board are laminated together to form the first acoustic chamber and the second acoustic chamber.

In further embodiments, the sound board is structured and arranged substantially non-parallel or slanted with respect to a longitudinal axis of the percussion instrument so as to form a double tapered first acoustic chamber and a double tapered second acoustic chamber.

In yet further embodiments, the first and second acoustic chamber housings and the sound board comprise one or more types of wood.

In embodiments, at least one of the first and second acoustic chamber housings and the sound board comprise one or more types of plastic.

In further embodiments, the first and second acoustic chamber housings are isolated from each other by the sound board arranged there between.

In yet further embodiments, particulate material arranged in the second acoustic chamber.

In embodiments, the particulate material comprises one or more types of sand.

In further embodiments, the percussion instrument further comprises a particulate material container, having particulate material therein, arranged in at least one of the first and second acoustic chambers.

In further embodiments, the sound board comprises at least one sound hole.

Aspects of further embodiments of the present invention are directed to a method of making a percussion instrument comprising a first acoustic chamber housing having a tapering shape; a second acoustic chamber housing having the tapering shape; a sound board having the tapering shape arranged between the first acoustic chamber housing and the second acoustic chamber housing. The method comprises bonding the first acoustic chamber housing, the sound board, and the second acoustic chamber housing together to form a first acoustic chamber defined by the first acoustic chamber housing and the sound board, and a second acoustic chamber defined by the second acoustic chamber housing and the sound board.

In embodiments, the method further comprises forming each of the first acoustic chamber housing, the sound board, and the second acoustic chamber housing to have respective corresponding tapering shapes.

In further embodiments, the method further comprises forming a first acoustic chamber space in the first acoustic chamber housing by removing material from the first acoustic chamber housing, and forming a second acoustic chamber space in the second acoustic chamber housing by removing material from the second acoustic chamber housing.

In additional embodiments, the method further comprises molding the first acoustic chamber housing to form a first acoustic chamber space, and molding the second chamber housing to form a second acoustic chamber space.

In yet additional embodiments, the method further comprises providing particulate material in the second acoustic chamber.

Aspects of further embodiments of the present invention are directed to a percussion instrument, comprising an acoustic chamber housing having a tapering shape, and a sound board having the tapering shape arranged on the acoustic chamber housing to form an acoustic chamber defined by the acoustic chamber housing and the sound board, wherein the sound board includes at least one sound hole.

Aspects of further embodiments of the present invention are directed to a percussion instrument, comprising a first acoustic chamber housing having a tapered shape, a second acoustic chamber housing having a complimentary tapered shape, and a sound board arranged between the first acoustic chamber housing and the second acoustic chamber housing to form a first acoustic chamber defined by the first acoustic chamber housing and the sound board, and a second acoustic chamber defined by the second acoustic chamber housing and the sound board.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

BRIEF DESCRIPTION OF THE FIGURES

For a more complete understanding of the invention, as well as other objects and further features thereof, reference may be had to the following detailed description of the invention in conjunction with the following exemplary and non-limiting drawings wherein.

Reference numbers refer to the same or equivalent parts of the present invention throughout the various figures of the drawings.

DETAILED DESCRIPTION OF EMBODIMENTS OF THE INVENTION

In the following description, the various embodiments of the present invention will be described with respect to the enclosed drawings.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice. As should be understood, at least some of the exemplary schematic representations are not necessarily drawn to scale in order to more clearly illustrate aspects of the present invention.

The descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiments were chosen and described in order to best explain the principles of the present invention and its practical application, to thereby enable others skilled in the art to best utilize the present invention and various embodiments with various modifications as are suited to the particular use contemplated As used herein, the singular forms "a," "an," and "the" include the plural reference unless the context clearly dictates otherwise. For example, reference to "a particulate material" would also mean that mixtures of one or more particulate materials can be present unless specifically excluded.

Except where otherwise indicated, all numbers expressing quantities of dimensions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not to be considered as an attempt to limit the application of the doctrine of equivalents to the scope of the claims, each numerical parameter should be construed in light of the number of significant digits and ordinary rounding conventions.

The various embodiments disclosed herein can be used separately and in various combinations unless specifically stated to the contrary.

Figure 1:
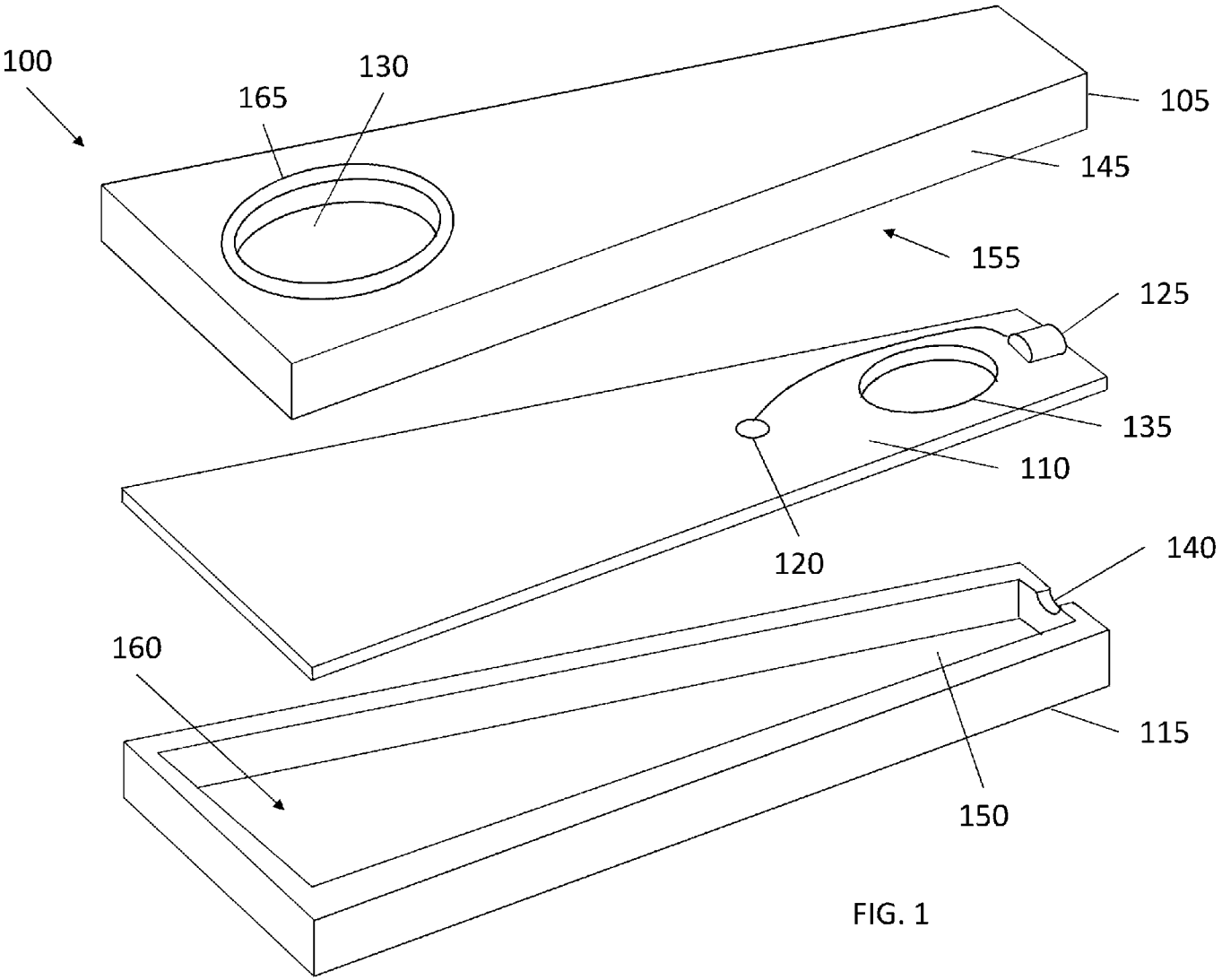
FIG. 1 illustrates an exemplary exploded view of the percussion instrument in accordance with aspects of embodiments of the invention.

FIG. 1 illustrates an exemplary exploded view of the percussion instrument 100 in accordance with aspects of embodiments of the invention. The percussion instrument 100 is a multi-percussive hand drum designed to create varied and rhythmic sounds, for example, for musical accompaniment and/or solo performance. The innovative design makes the percussion instrument 100 beneficial to any percussion artist or drummer in the music industry, and/or for amateurs looking to experience a new dimension of percussive expression.

The percussion instrument 100 may be used for stage performance, recording studios and even synthesized sound effects for movie making. Because the percussion instrument 100 offers variations of use, a person may not need to purchase another drum or instrument in order to achieve a multitude of varying percussion sounds and tones. The percussion instrument 100 stands out from any other drum because it is compact, portable and can be plugged into any sound system to provide amplification.

The percussion instrument 100 provides users with a multifunctional musical instrument. In embodiments, the percussion instrument 100 may be in the shape of a tapered rectangle (e.g., trapezoidal) so that it has varying pitch when the percussion instrument 100 is struck. The larger end offers deeper tones, while the smaller end produces higher tones. The percussion instrument 100 may have two hollow chambers that are fastened to a middle sound board. One of the chambers may include a sound hole on the top of the percussion instrument 100, while the other does not. The sound hole on the top of the drum creates a natural sound, and also allows for bending tones when the users put their hand over the hole and strike the drum.

As shown in FIG. 1, the percussion instrument 100 includes a first acoustic chamber housing 105 and a second acoustic chamber housing 115. As shown in FIG. 1, with this embodiment, each of the acoustic chamber housing 105 and the second acoustic chamber housing 115 are structured in a tapered shape (e.g., a trapezoidal shape).

In particular embodiments, each of the first acoustic chamber housing 105 and the second acoustic chamber housing 115 may comprise a solid piece of material (e.g., wood, plastic, metal, composite) that has been hollowed out or formed to create a respective chamber volume with an opening (155, 160) on one side. In some embodiments, the first acoustic chamber housing 105 may include a sound hole 130 (e.g., arranged on a wall of the acoustic chamber housing 105 opposite the opening 155, for example, on an opposite side and/or an opposite end). In accordance with aspects of the invention, the sound hole 130 allows some of the generated sound to exit from the percussion instrument 100 through the sound hole 130 in a similar manner to a sound hole on an acoustic guitar. A microphone (e.g., a condenser or dynamic microphone) may be placed proximate the sound hole 130 to capture the generated sounds of the percussion instrument. Additionally, in accordance with further aspects of the invention, the sound hole 130 also provides an ingress location for sounds (for example, vocal sounds of a user) that can be picked up by an internal pickup device and combined with the sounds generated within the percussion instrument 100. For example, a user could sing, speak, and/or whistle into the sound hole 130 to create special sonic effects, while playing a percussive rhythm on the percussion instrument 100. As shown with the exemplary embodiment of FIG. 1, the sound hole 130 may include a reinforcement ring 165. In accordance with aspects of the invention, the reinforcement ring 165 may be functional, by providing a smooth surface around the sound hole 130, for example, to prevent splinters. Additionally, the reinforcement ring 165 may provide additional aesthetic features for the percussion instrument 100. While the exemplary embodiment of FIG. 1 includes a single sound hole 130, the invention contemplates embodiments having more than one sound hole and embodiments having no sound holes.

As shown in FIG. 1, the percussion instrument 100 also includes a sound board 110 arranged between the first acoustic chamber housing 105 and the second acoustic chamber housing 115, which together with the first acoustic chamber housing 105 and the second acoustic chamber housing 115, respectively, define a first acoustic (or resonation) chamber 145 and a second acoustic chamber 150. The sound board 110 is structured and arranged having the same tapered shape so as to completely cover both the first acoustic chamber housing 105 and the second acoustic chamber housing 115, and to isolate the first acoustic chamber 145 from the second acoustic chamber 150. Additionally, as shown in FIG. 1, in embodiments, the sound board 110 is arranged generally parallel to the longitudinal axis of the percussion instrument 100 and the tapered surfaces of the first acoustic chamber housing 105 and the second acoustic chamber housing 115.

Also, as shown in FIG. 1, in embodiments, the sound board 110 includes at least one sound hole 135. In embodiments, the sound hole 135 may be the same size as sound hole 130, or may be larger or smaller than sound hole 130. In accordance with aspects of embodiments of the invention, the sound hole 135 is structured and arranged to allow sound to resonate between the two acoustic chambers. As shown in FIG. 1, the sound hole 135 may be arranged in the sound board 110 towards the narrower end of the percussion instrument 100 (i.e., at an opposite end from the sound hole 130). The invention, however, contemplates arranging the sound hole 135 in other areas of the sound board 110 (e.g., towards the wider end of the percussion instrument 100). Moreover, while the exemplary embodiment depicted in FIG. 1 shows the sound hole 130 arranged toward the wider end of the percussion instrument 100 and the sound hole 135 arranged toward the narrower end of the percussion instrument 100, the invention contemplates an opposite arrangement (e.g., the sound hole 130 arranged toward the narrower end of the percussion instrument 100 and the sound hole 135 arranged toward the wider end of the percussion instrument 100). While the exemplary embodiment depicted in FIG. 1 shows a single sound hole 135, the invention contemplates embodiments having more than one sound hole 135 in the sound board, and embodiments having no sound hole in the sound board.

As shown in FIG. 1, the soundboard 110 has arranged (e.g., fastened and/or bonded) thereon, a pickup device 120, for example, a piezo transducer, that connects with a jack 125 (e.g., a ¼" jack) via suitable wiring. As additionally shown in the exemplary embodiment of FIG. 1, the first acoustic chamber housing 105 and the second acoustic chamber housing 115 may each include a notch 140 structured and arranged to accommodate portions of the ¼" jack 125.

In the exemplary embodiment of FIG. 1, the pickup device 120 is arranged on a side of the soundboard 110 facing the first acoustic chamber housing 105 so as to be located within the first acoustic chamber 145. Alternative embodiments of the present invention contemplate an opposite orientation (i.e., the pickup device 120 being arranged on a side of the soundboard 110 facing the second acoustic chamber housing 115 so as to be located within the second acoustic chamber 150. In accordance with aspects of the invention, the pickup device 120 allows the percussion instrument 100 to be connected to an amplifier or a public announcement (PA) system, to amplify the sounds (e.g., tapping rhythms) generated within the percussion instrument 100, and/or connected to effects devices (e.g., stomp boxes, multi-effects pedals, rack-mounted effects, etc.) to modify (e.g., delay, loop, distort, modulate, etc.) the sounds generated within the percussion instrument 100. While the exemplary embodiment of FIG. 1 illustrates a piezo transducer pickup device 120, the present invention contemplates other or additional pickup devices. For example, in contemplated embodiments, the pickup device 120 may comprise a microphone (e.g., a dynamic or condenser microphone) instead of (or in addition to) the piezo transducer. Moreover, if multiple pickup devices are utilized, the percussion instrument 100 may also include a mixer/blend control to mix and/or blend the multiple pickup devices.

In some contemplated embodiments, the percussion instrument 100 can be completely organic. With such embodiments, a beauty of the lap cajón percussion instrument 100 is that it is all natural. The lap cajón percussion instrument 100 has, for example, one to two pickups, that capture the resonating sound of the natural wood.

In additional contemplated embodiments, the percussion instrument may include triggers. A trigger is an electronic transducer that can be attached to a drum, cymbal or other instrument to enable it to control an electronic device, e.g., an electronic drum unit or similar device. Triggers, which are also referred to as synthesizer pickups, are pickups that are controllable by a computer. An advantage of using drum triggers is that less effort may be required from the drummer, since the sensitivity of the trigger can be adjusted to make even the softer hit sound like a loud stroke, and the sound of each one of the drum pieces can be individually equalized as the drummer wishes, and no matter how hard (or soft) the drummer hits, all the pieces will be heard with the same volume. Triggers may be used in live performances and in studio recordings.

A user may, for example, assign sounds (e.g., patches) with a computer to each trigger (pickup). So, for example, if the percussion instrument includes six synthesizer pickups (e.g., at different locations within or on the percussion instrument), the percussion instrument would have six triggers that can be programmed with any desirable sound. The trigger-synthesized sounds are produced from an external source, e.g., a computer processor and an amplifier system. Upon impacting a particular trigger in a particular region of the percussion instrument, e.g., by impacting the percussion instrument with a hand, the external source is triggered to produce a particular sound.

In accordance with aspects of the invention, a piezo transducer is used to convert the vibrational or physical movement of the piezo transducer (and the movement of the sound board 110 upon which the piezo transducer is arranged) into an electrical signal. By arranging the piezo transducer in the percussion instrument 100, all of the external surfaces of the percussion instrument are "alive" or "ignited." In accordance with additional aspects of the invention, the piezo-equipped soundboard 110 can serve as a versatile resonator/pickup not only for the percussion instrument's own sounds, but also for other instruments. For example, the percussion instrument 100 may be played while the percussion instrument 100 is arranged on a drum or other percussion instrument (e.g., a snare drum or a floor tom drum). As the percussion instrument 100 is impacted to generate a sound, the impact also actuates the snare drum or the floor tom. In accordance with aspects of the invention, the piezo transducer captures both the sounds of the percussion instrument 100 and the sounds of the snare drum or the floor torn, to create a composite sound that can be routed through, for example, one or more effects, a loop station, an amplifier, a rotary cabinet, and/or PA system.

With the exemplary embodiment of FIG. 1, the pickup device 120 is generally arranged towards the center of the sound board 110 with respect to a longitudinal axis of the percussion instrument 100. The invention contemplates, however, that the pickup device 120 may be arranged at positions on the sound board 110 other than in the region of the center. For example, in some contemplated embodiments, the pickup device 120 may be arranged closer to (or further from) the jack 125. Furthermore, while the exemplary embodiment of FIG. 1 illustrates a ¼"jack, the invention contemplates that other connection jacks may be utilized (e.g., a 3.5 mm jack or XLR jack, amongst other contemplated jacks).

In accordance with additional aspects of the invention, the tapered shape of the percussion instrument 100 provides multiple regions and different surfaces that produce varying tones. For example, some surfaces and regions of the percussion instrument 100 produce (e.g., upon tapping, impacting, etc.) lower frequency tones, while other surfaces (e.g., adjacent surfaces) may produce higher frequency tones. In other words, in accordance with aspects, of the invention, the percussion instrument 100 has a tone changing (or variable) quality, wherein every surface and region can produce a different tone. For example, there are certain places on the percussion instrument 100 that will produce bass frequency tones, such as, for example, the end of the percussion instrument 100 (farthest away from the jack). Hitting this area of the percussion instrument with the palm of a hand will produce a deep bass frequency tone. Also, hitting the center area of the percussion instrument 100 with the palm or heal produces a deep bass frequency tone. The pitch gets higher as the impact area is moved further toward the narrower end of the percussion instrument 100. Higher frequency tones may be achieved by hitting with a finger (e.g., a tapping or slapping with a finger). The tone can even be altered by using one finger versus using two fingers. The ranges of the tone frequencies (e.g., the higher tone frequencies) can be altered based on how the percussion instrument is impacted, where the percussion instrument 100 is impacted, and what the percussion instrument 100 is impacted with (such as, for example, a finger, drum mallets or brushes).

Also, due to the tapering shape, the type and location of impact (e.g., finger, palm, hand) may affect the produced tone. For example, every surface and/or region may have a different tone depending upon how the surface is impacted (e.g., hitting with the heal of a hand versus hitting with one finger). In accordance with further aspects of the invention, the location of the impact site relative to the pickup 120 affects the produced tone of the percussion instrument 100.

In contemplated embodiments, the first acoustic chamber housing 105, the second acoustic chamber housing 115 and the sound board 110 may be crafted out of one or more woods (e.g., burl and high figured woods), plastics, metals and/or other composite materials. With regard to wood materials, generally, in embodiments, the first acoustic chamber housing 105 and the second acoustic chamber housing 115 may include any sufficiently dense (or harder) wood in order to capture the vibrations of (or within) the percussion instrument 100. For example, with non-limiting embodiments, the wood for the first acoustic chamber housing 105 and the second acoustic chamber housing 115 may include one or more of walnut, redwood, maple, and purple heart, amongst other contemplated woods. In embodiments, the wood for the sound board 110 may be a softer (e.g., less dense) wood in order to resonate in the percussion instrument 100. For example, with non-limiting embodiments, the wood for sound board 110 may include spruce and cedar, amongst other contemplated woods. In contemplated embodiments, the sound board 110 may comprise multiple wood layers (e.g., a laminate of different woods) to manipulate the tonal quality of the percussion instrument 100 and/or to compensate for natural materials of the sound board 110.

While the above exemplary embodiment has been described with regard to wood materials, the present invention contemplates embodiments comprising different materials. For example, in embodiments of the present invention, the sound board, the first acoustic chamber housing, and/or the second acoustic chamber housing may be constructed using plastic materials. With one contemplated exemplary embodiment, the first acoustic chamber housing and the second acoustic chamber housing comprise plastic materials (e.g., molded plastic), and the sound board comprises a wood material. With another contemplated exemplary embodiment, the first acoustic chamber housing, the second acoustic chamber housing, and the sound board comprise plastic materials (e.g., molded plastic).

In further embodiments of the present invention, the sound board, the first acoustic chamber housing and/or the second acoustic chamber housing may be constructed using metal materials. In yet further embodiments of the present invention, the sound board, the first acoustic chamber housing and/or the second acoustic chamber housing may be constructed using composite materials.

In yet further embodiments of the present invention, the first acoustic chamber housing 105 and/or the second acoustic chamber housing 115, instead of comprising one piece of material, may comprise two pieces of the same or different material (e.g., one piece defining the side walls and the other piece defining the top or bottom wall). As such, with contemplated embodiments, the percussion instrument 100 may comprise a three-piece laminate, a four-piece laminate, or a five-piece laminate.

Figure 2:
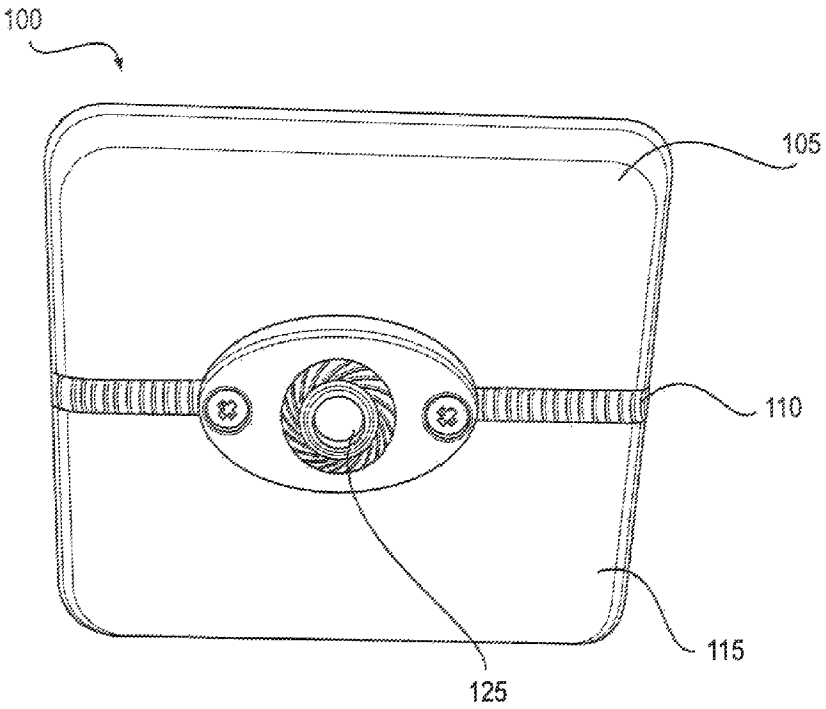
FIG. 2 shows an exemplary view of the percussion instrument in accordance with aspects of the invention.

FIG. 2 shows an exemplary view of an assembled percussion instrument 100 in accordance with aspects of the invention. With an exemplary embodiment, the second acoustic chamber housing 115 (and the first acoustic chamber housing 105) may be formed, for example, using a computer numerical control (CNC) machine to hollow out a chamber space from respective solid pieces of wood. With an exemplary and non-limiting embodiment, the percussion instrument 100 may measure to be approximately 12" in length and 2" in width, to approximately 30" in length and 4" in width, with other larger and smaller dimensions contemplated by the present invention. It should be understood that the exact specifications, materials used, and method of use of the percussion instrument 100 may vary upon manufacturing.

With an exemplary embodiment, a piece of wood having a 1" thickness may be hollowed out to form walls (e.g., side and bottom walls) having a ⅛" thickness. As shown in FIG. 2, the second acoustic chamber housing 115 and the first acoustic chamber housing 105 are bonded together (e.g., laminated together with an adhesive or glue) with the sound board 110 there between (or each of the second acoustic chamber housing 115 and the first acoustic chamber housing 105 are bonded to the sound board 110) to form an embodiment of the percussion instrument 100.

Figure 3:
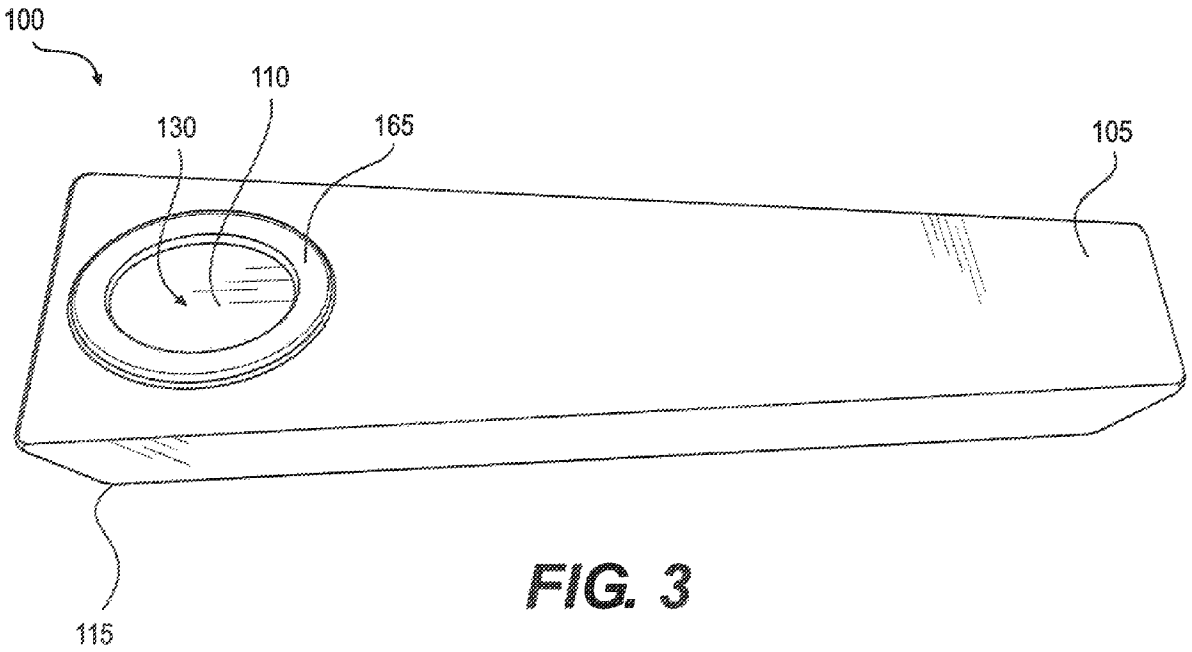
FIG. 3 shows an exemplary view of contemplated embodiment of the present invention.

FIG. 3 shows a view of a contemplated embodiment of the present invention. As shown in FIG. 3, the invention contemplates embodiments having one or more sound holes 130 (e.g., percussion instrument 100) and embodiments without a sound hole (not shown). As should be understood, the present invention may come in a variety of sizes and exact specifications may vary to suit manufacturing needs. Additionally, the one or more sound holes 130 may be in a variety of sizes, in order to vary the tone of the percussion instrument.

Figure 4:
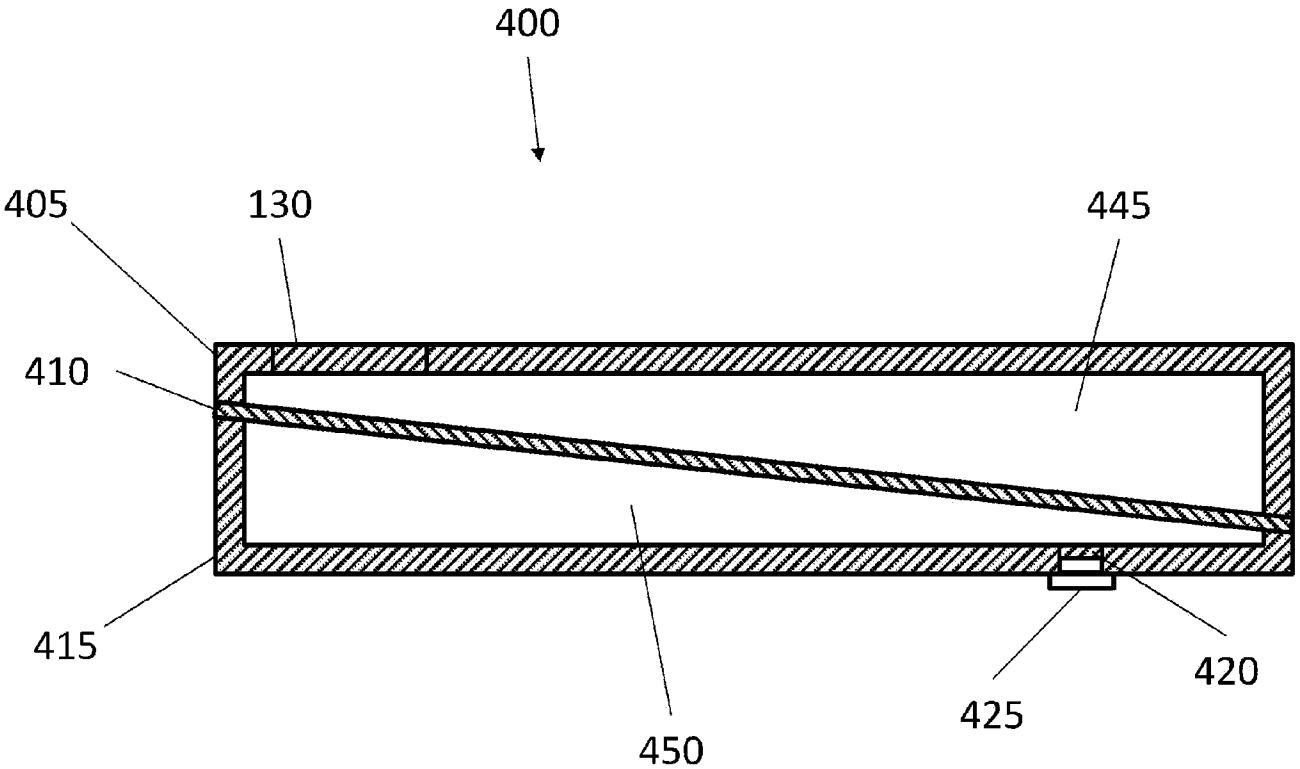
FIG. 4 shows exemplary schematic representation of a "double tapered" percussion instrument in accordance with aspects of the invention.

FIG. 4 shows exemplary sectional schematic representation of a "double tapered" percussion instrument 400 in accordance with aspects of the invention. As shown in FIG. 4, with the "double tapered" percussion instrument 400, the sound board 410 is arranged to slant from one end to the other end of the percussion instrument 400 such that both the second acoustic chamber 450 and the first acoustic chamber 445 are tapered along an additional axis of the percussion instrument 400 (e.g., an axis approximately orthogonal to the tapered shape of the percussion instrument 400, i.e., an axis approximately orthogonal to the tapered surfaces of the first acoustic chamber housing 105 and the second acoustic chamber housing 115). For example, as shown in FIG. 4, from left to right (e.g., in a direction away from the sound hole 130), the height of the first acoustic chamber 445 progressively increases and the height of the second acoustic chamber 450 progressively decreases. The invention also contemplates the opposite orientation (not shown), wherein in a direction away from the sound hole, the height of the first acoustic chamber progressively decreases and the height of the second acoustic chamber progressively increases. As additionally shown in the exemplary schematic representation of FIG. 4, embodiments of the "double tapered" percussion instrument 400 may include a double tapered first acoustic chamber housing 405 and a complimentary double tapered second acoustic chamber housing 415. In accordance with aspects of the invention, the double tapered first acoustic chamber housing 405 and the complimentary double tapered second acoustic chamber housing 415 are structured and arranged so that the sound board 410 arranged there between adopts a slanted orientation. In accordance with aspects of this embodiment of the present invention, the double tapered design further alters the emitted tone of the percussion instrument 400 along the longitudinal axis of the instrument, e.g., to emit different tones as a user strikes the instrument at different points along the longitudinal axis of the instrument. As shown in the exemplary embodiment of FIG. 4, in some contemplated embodiments, the sound board may not include a sound hole therein.

As additionally shown in FIG. 4, the second acoustic chamber 415 may be configured as a "sand" chamber housing. The second acoustic chamber 415 includes a hole 420 and associated removable cap 425 to facilitate changing of particulate material, e.g., sand, (not shown) in the second acoustic chamber 450.

In accordance with additional aspects of the invention, the generated sound of the percussion instrument 400, e.g., due to tapping, can be modified based on the location of the particulate material (not shown) in the "sand" chamber housing and/or where the percussion instrument is impacted (or struck). For example, if the sand is moved to one end of the sand chamber, upon impacting (e.g., tapping) the percussion instrument 400 in the middle, the percussion instrument 400 may emit a tighter sound (e.g., similar to a kick drum). In contrast, with the sand (not shown) located at one end of the sand chamber 450, impacting the other end of the percussion instrument 400 may produce a clear sound. If the sand is spread throughout the sand chamber 450, the percussion instrument 400 will emit a bigger sound (e.g., similar to a snare drum) upon impacting the percussion instrument 400.

In accordance with aspects of the invention, the sand allows the percussion instrument 400 to be used as a shaker, for example, by orienting the percussion instrument 400 in a generally horizontal direction, and shaking the percussion instrument 400 to move the sand within the sand chamber 450, to create the shaker sound.

Figure 5:
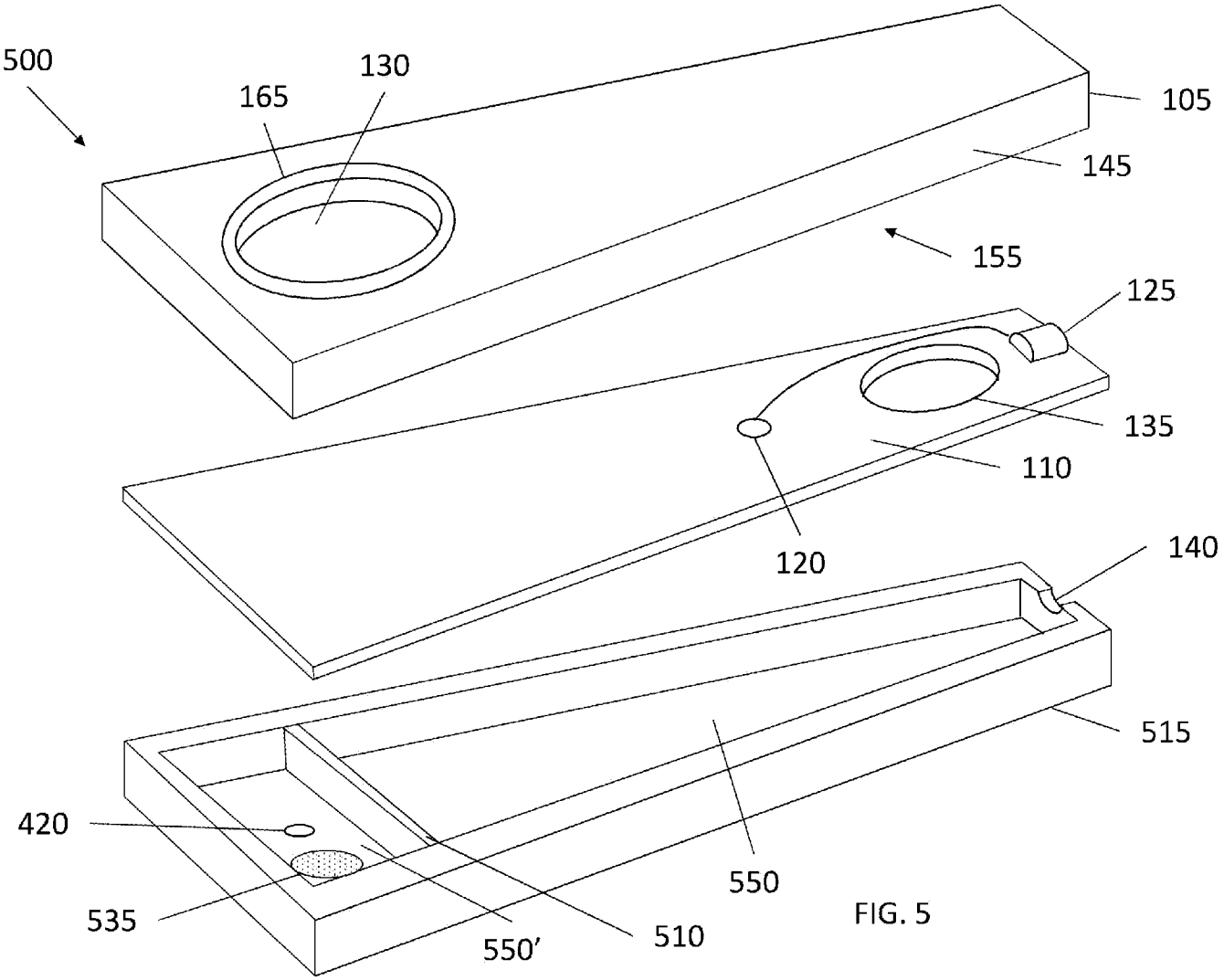
FIG. 5 shows an exemplary exploded view of the percussion instrument in accordance with aspects of embodiments of the invention.

FIG. 5 shows an exemplary and non-limiting depiction of a percussion instrument 500 in accordance with embodiments of the present invention. This exemplary embodiment is similar to the embodiment of FIG. 1, wherein at least a portion of the second acoustic chamber 515 is configured as a sand chamber.

As shown in FIG. 5, the percussion instrument 500 also includes a material (e.g., sand) 535 (or other suitable particulate material, such as glass and/or plastic beads) arranged in a portion 550' (or sand chamber) of the second acoustic chamber 550. The material 535 may be constrained in the portion 550' of the second acoustic chamber 550 by a partition wall 510. While the partition wall 510 is shown in a particular location, the invention contemplates that the partition wall 510 may be structured and arranged to provide a larger or smaller portion 550' (or sand chamber).

The sand chamber housing 515 may also include a hole 420 and an associated removable cap (not shown) structured and arranged to seal the hole. In embodiments, the cap may be located on an end of the percussion instrument 500 opposite to the sound hole 130 (e.g., on an opposite end and/or on an opposite side). In accordance with additional aspects of embodiments of the invention, the cap may be temporarily removable so that a user may, for example, change the sand 535 (or other suitable particulate material) in the sand chamber 550'. By altering the type of sands 135 or other suitable particulate material contained in the sand chamber 550' (e.g., from fine sand to coarse sand), a user may alter the achievable sounds and sonic textures of the percussion instrument 500. In embodiments, the cap may be a pressure-fitting cap or may be a threaded cap. The present invention also contemplates embodiments without a hole, wherein the sand (or other suitable particulate matter) is not changeable without removing the sand chamber housing 515 from the sound board 110.

With additional contemplated embodiments, the percussion instrument 500 may contemporaneously utilize more than one type of sand (or other suitable particulate material). For example, a user may arrange two different types of particulate material in the sand chamber, to generate a composite sound, which may include the interactions (e.g., impacts) of each of the particulate material types with the walls of the sand chamber 550, and interactions (e.g., impacts) of the particulate material types with each other. With other contemplated embodiments, the percussion instrument may include a plurality of sand chambers, for example, arranged above one another with respect to a longitudinal axis of the percussion instrument 500, wherein each of the sand chambers includes a respective type of particulate material. That is, the sand chamber 550 illustrated in FIG. 1 may include a horizontal partition (not shown) arranged approximately parallel to the sound board 510 to divide the second acoustic chamber housing 515 into two sand chambers. In further contemplated embodiments, the plurality of sand chambers may be arranged, for example, one behind the other with respect to a longitudinal axis of the percussion instrument 500. That is, the sand chamber 550' illustrated in FIG. 5 may include an additional partition (not shown) arranged perpendicular to the sound board 110 to divide the sand chamber 550' into two sand chambers.

Figure 6:
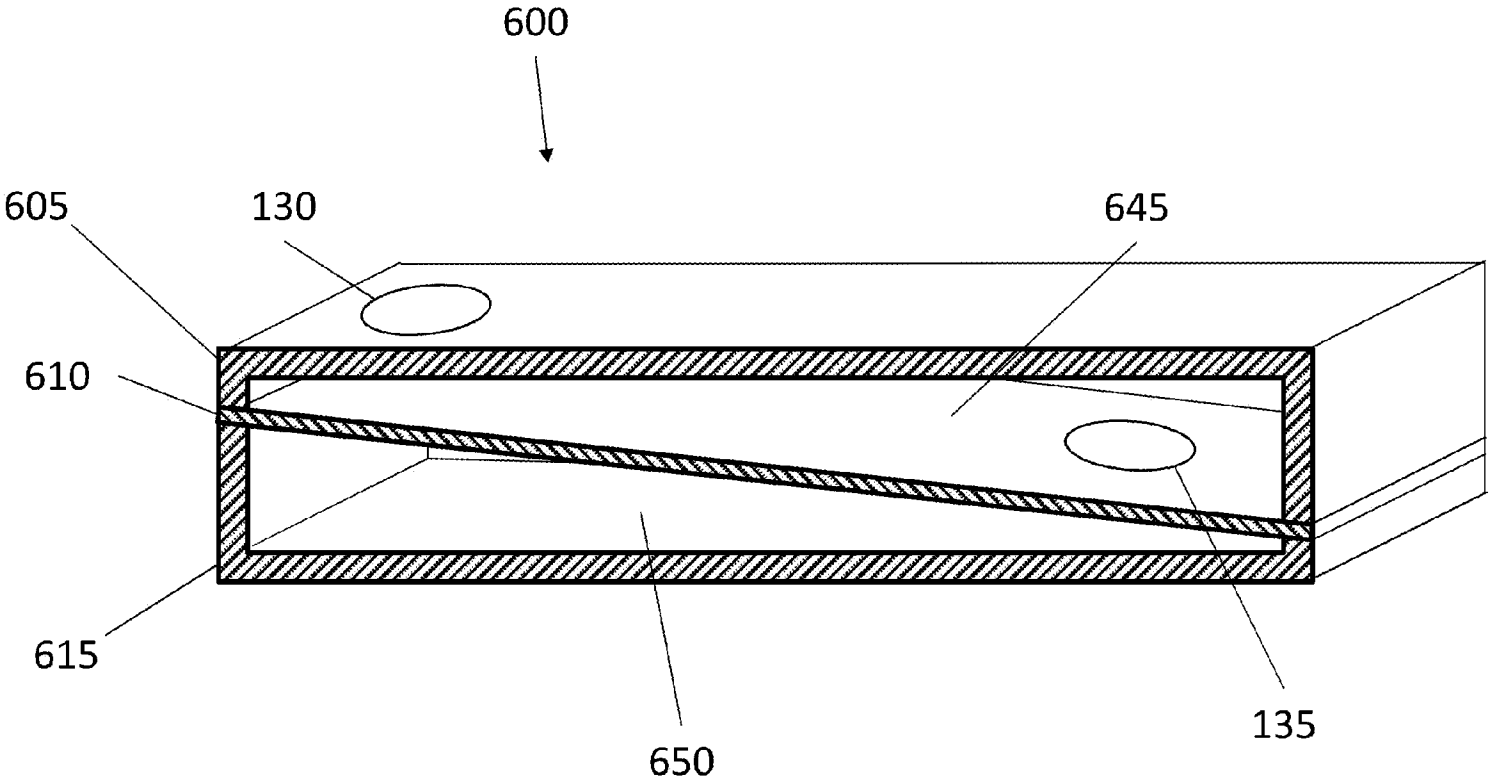
FIG. 6 shows an exemplary schematic representation of a percussion instrument in accordance with aspects of embodiments of the invention.

FIG. 6 shows an exemplary and non-limiting depiction of a percussion instrument 600 in accordance with embodiments of the present invention. With this exemplary embodiment, the percussion instrument 600 may embody a rectangular prism shape (in contrast to the tapered shape), wherein the sound board 610 (with a sound hole 135) is arranged in a slanting manner (similar to the embodiment of FIG. 4). With such an embodiment, while the overall shape of the instrument is a rectangular prism shape, the first acoustic chamber 645 and the second acoustic chamber 650 are arranged as tapered acoustic chambers, due to the tapered shape of the first acoustic chamber housing 605 and the complimentary tapered shape of the second acoustic chamber housing 615.

Figure 7:
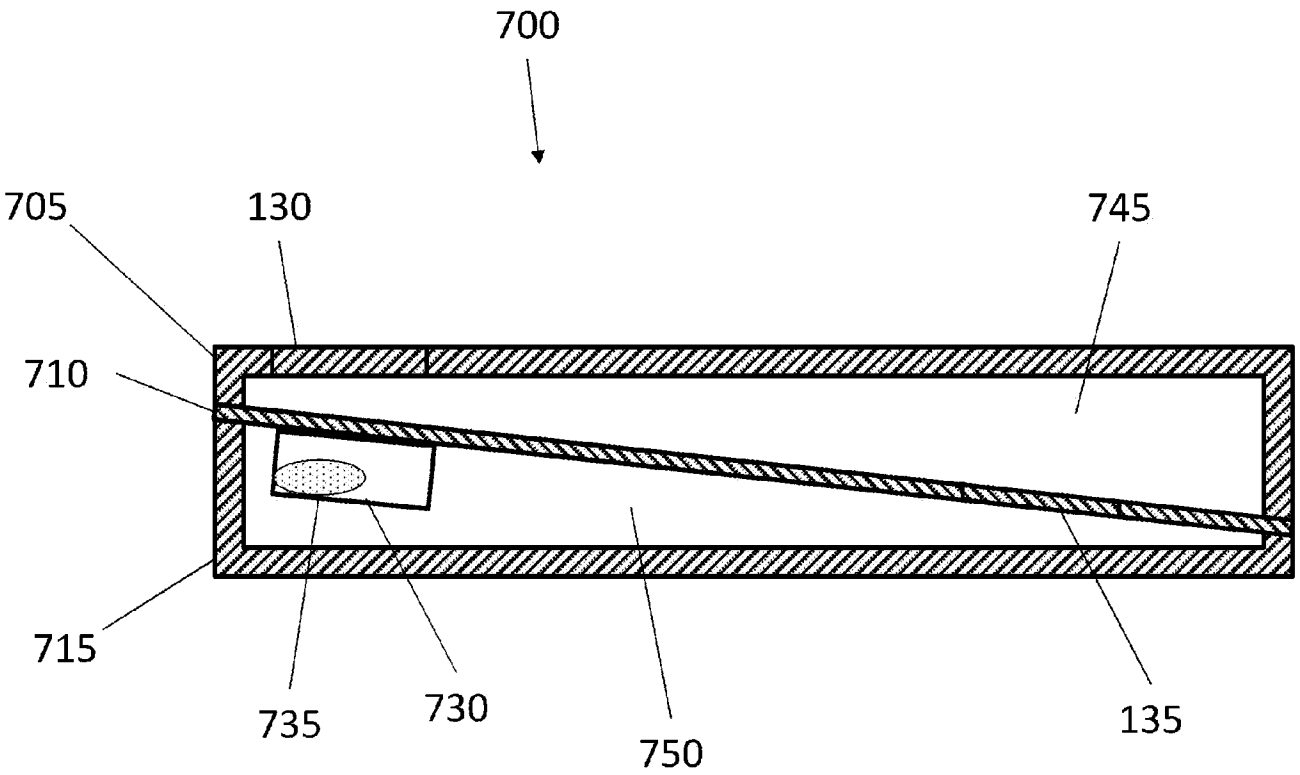
FIG. 7 shows an exemplary schematic representation of the percussion instrument in accordance with aspects of embodiments of the invention.

FIG. 7 shows an exemplary and non-limiting depiction of a percussion instrument 700 in accordance with embodiments of the present invention. With this exemplary embodiment, the second acoustic chamber 750 includes a particulate material container 730 arranged therein. The particle material container 730 is structured and arranged to act as a self-contained shaker, and includes particulate material (e.g., sand) 735 arranged within the particle material container 730. As shown in the exemplary embodiment of FIG. 7, the particle material container 730 may be arranged on a side of the sound board 710, so as to be enclosed by the second acoustic chamber 750. The invention, however, contemplates that the particle material container 730 may be arranged on the opposite side of the sound board 710, so as to be enclosed by the first acoustic chamber 745. Additionally, with the depicted embodiment, the particle material container 730 is arranged below the sound hole 130. The invention, however, contemplates that the particle material container 730 may be arranged in other regions of the percussion instrument 700. As should be understood, while illustrated in FIG. 7 as including a slanted sound board 710 (with the sound hole 135), the invention contemplates that the sound board 710 and the particle material container 730 attached thereto, may be arranged parallel to the congruently tapered walls of the first and second acoustic chamber housings 705 and 715. In embodiments, the particle material container 730 may be fixedly arranged in the first or second acoustic chamber as the percussion instrument is being assembled. While described as being fixedly arranged, the invention contemplates embodiments in which the particle material container 730 may be removable and/or interchangeable with differently configured particle material containers (e.g., having a different shape and/or different particulate material).

Figure 8:
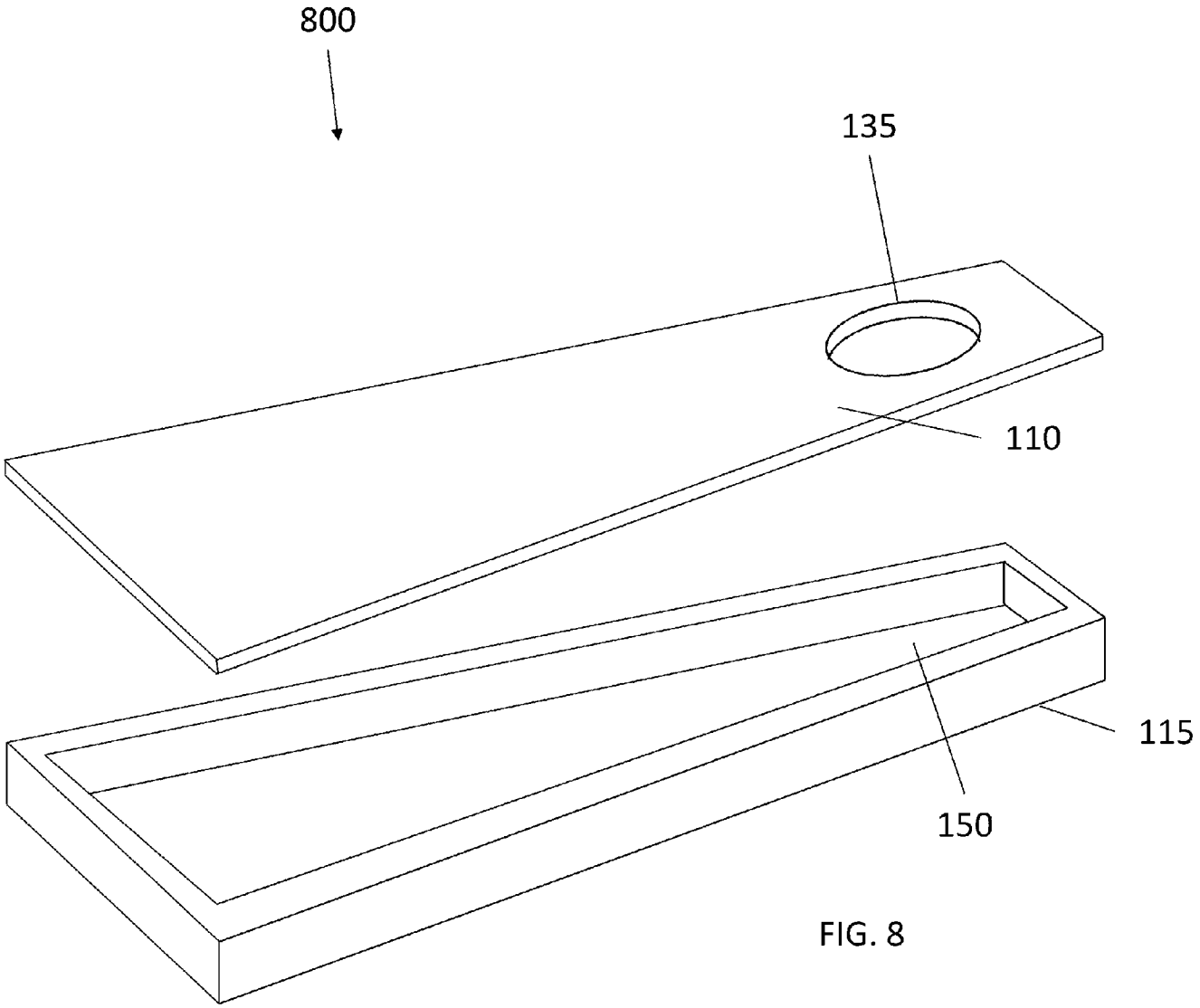
FIG. 8 shows an exemplary exploded view of a percussion instrument in accordance with aspects of embodiments of the invention.

FIG. 8 shows an exemplary schematic representation of a percussion instrument 800 in accordance with aspects of the invention. With this exemplary embodiment, the invention includes a single chamber, for example, an acoustic chamber 115 (e.g., formed by the first or second acoustic chamber housing and a sound board 110 having a sound hole 135). In accordance with aspects of embodiments of the invention, as shown in FIG. 8, the percussion instrument may be electronics-free, e.g., no pick-up, and no jack. While the exemplary embodiment of FIG. 8 has the sound hole 135 arranged towards the narrower end of the percussion instrument 800, the invention contemplates that the sound hole 135 may be arranged in different areas of the sound board 110 (e.g., towards the wider end of the percussion instrument 800).

What has been described above includes examples of the disclosed architecture. It is, of course, not possible to describe every conceivable combination of components and/or methodologies, but one of ordinary skill in the art may recognize that many further combinations and permutations are possible. For example, while the above exemplary embodiments have a tapered shape, the present invention contemplates embodiments having a dual tapered shape, e.g., an inwardly-directed taper followed by an outwardly-directed taper (or bow-tie shape), or an outwardly-directed taper followed by an inwardly-directed taper, or embodiments have a non-linear taper.

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the invention has been described with reference to specific embodiments, those skilled in the art will understand that various changes may be made and equivalents may be substituted for elements thereof without departing from the true spirit and scope of the invention. In addition, modifications may be made without departing from the essential teachings of the invention.

What is claimed is:

1. A percussion instrument, comprising:

a first acoustic chamber housing having a tapered shape;

a second acoustic chamber housing having the tapered shape;

a sound board having the tapered shape arranged between the first acoustic chamber housing and the second acoustic chamber housing to form a first acoustic chamber defined by the first acoustic chamber housing and the sound board, and a second acoustic chamber defined by the second acoustic chamber housing and the sound board, wherein the sound board comprises at least one sound hole.

2. The percussion instrument of claim 1, further comprising a pickup device arranged on the sound board.

3. The percussion instrument of claim 2, wherein the pickup device comprises a piezo transducer.

4. The percussion instrument of claim 2, further comprising an instrument jack connected to the pickup device and arranged at an exterior surface of the percussion instrument.

5. The percussion instrument of claim 1, wherein the sound board is structured and arranged substantially parallel to a longitudinal axis of the percussion instrument.

6. The percussion instrument of claim 1, wherein at least one of the first and second acoustic chamber housings comprises at least one sound hole.

7. The percussion instrument of claim 1, wherein the sound board is structured and arranged to resonate.

8. The percussion instrument of claim 1, wherein the first acoustic chamber housing, the second acoustic chamber housing, and the sound board are laminated together to form the first acoustic chamber and the second acoustic chamber.

9. The percussion instrument of claim 1, wherein the sound board is structured and arranged substantially non-parallel or slanted with respect to a longitudinal axis of the percussion instrument so as to form a double tapered first acoustic chamber and a double tapered second acoustic chamber.

10. The percussion instrument of claim 1, wherein the tapered shape comprises at least one of a trapezoidal shape, a dual trapezoidal shape, and a non-linear tapered shape.

11. The percussion instrument of claim 1, wherein the first acoustic chamber housing, the second acoustic chamber housing, and the sound board comprise one or more types of wood.

12. The percussion instrument of claim 1, wherein at least one of the first acoustic chamber housing, the second acoustic chamber housing, and the sound board comprise one or more types of plastic.

13. The percussion instrument of claim 1, wherein the first acoustic chamber is isolated from the second acoustic chamber by the sound board arranged there between.

14. The percussion instrument of claim 1, further comprising particulate material arranged in the second acoustic chamber.

15. The percussion instrument of claim 14, wherein the particulate material comprises one or more types of sand.

16. The percussion instrument of claim 1, further comprising a particulate material container, having particulate material therein, arranged in at least one of the first and second acoustic chambers.

17. A percussion instrument, comprising:

a first acoustic chamber housing having a tapered shape;

a second acoustic chamber housing having the tapered shape;

a sound board having the tapered shape arranged between the first acoustic chamber housing and the second acoustic chamber housing to form a first acoustic chamber defined by the first acoustic chamber housing and the sound board, and a second acoustic chamber defined by the second acoustic chamber housing and the sound board;

a pickup device arranged on the sound board; and an instrument jack connected to the pickup device and arranged at an exterior surface of the percussion instrument, wherein the first acoustic chamber housing, the second acoustic chamber housing, and the sound board are laminated together to form the first acoustic chamber and the second acoustic chamber, and wherein the sound board includes at least one sound hole.

18. A method of making a percussion instrument comprising a first acoustic chamber housing having a tapered shape; a second acoustic chamber housing having the tapered shape; a sound board having the tapered shape arranged between the first acoustic chamber housing and the second acoustic chamber housing, the method comprising:

bonding the first acoustic chamber housing, the sound board, and the second acoustic chamber housing together to form a first acoustic chamber defined by the first acoustic chamber housing and the sound board, and a second acoustic chamber defined by the second acoustic chamber housing and the sound board, wherein the sound board includes at least one sound hole.

19. The method of claim 18, further comprising forming each of the first acoustic chamber housing, the sound board, and the second acoustic chamber housing to have respective corresponding tapered shapes.

20. The method of claim 18, further comprising:

forming a first acoustic chamber space in the first acoustic chamber housing by removing material from the first acoustic chamber housing, and forming a second acoustic chamber space in the second acoustic chamber housing by removing material from the second acoustic chamber housing.

21. The method of claim 18, further comprising:

molding the first acoustic chamber housing to form a first acoustic chamber space, and molding the second acoustic chamber housing to form a second acoustic chamber space.

22. The method of claim 18, further comprising providing particulate material in the second acoustic chamber.

23. A percussion instrument, comprising:

an acoustic chamber housing having a tapered shape; and a sound board having the tapered shape arranged on the acoustic chamber housing to form an acoustic chamber defined by the acoustic chamber housing and the sound board, wherein the sound board includes at least one sound hole.

24. A percussion instrument, comprising:

a first acoustic chamber housing having a tapered shape;

a second acoustic chamber housing having a complimentary tapered shape;

a sound board arranged between the first acoustic chamber housing and the second acoustic chamber housing to form a first acoustic chamber defined by the first acoustic chamber housing and the sound board, and a second acoustic chamber defined by the second acoustic chamber housing and the sound board, wherein the sound board includes at least one sound hole.

* * * * *